US006283729B1

(12) United States Patent
Makino et al.

(10) Patent No.: US 6,283,729 B1
(45) Date of Patent: Sep. 4, 2001

(54) CLOSED COMPRESSOR HAVING A COMPRESSION MECHANISM HOLDER AND METHOD OF ASSEMBLING SAME

(75) Inventors: Masahiko Makino, Yasu-gun; Yoshifumi Abe, Kurita-gun; Norio Yoshida, Moriyama, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/490,075

(22) Filed: Jan. 24, 2000

(30) Foreign Application Priority Data

Jan. 25, 1999 (JP) ..... 11-015618

(51) Int. Cl.[7] ..... F04B 17/00

(52) U.S. Cl. ..... 417/410.3; 417/410.5; 417/360

(58) Field of Search ..... 417/410.3, 410.5, 417/360; 418/55.1, 179

(56) References Cited

U.S. PATENT DOCUMENTS 5,496,160 * 3/1996 Richardson, Jr. ..... 418/55.1
5,735,678 * 4/1998 Fukuhara et al. ..... 418/55.2
5,846,065 * 12/1998 Sano et al. ..... 418/55.2

FOREIGN PATENT DOCUMENTS 8-74753 3/1996 (JP) .
9-287585 11/1997 (JP) .

* cited by examiner

*Primary Examiner*—Charles G. Freay
*Assistant Examiner*—Michael K. Gray
(74) *Attorney, Agent, or Firm*—Wenderoth, Lind & Ponack, L.L.P.

(57) ABSTRACT

A closed compressor includes a compression mechanism contained in a closed vessel and a motor drive section for driving the compression mechanism. A compression mechanism holder is secured to the inner surface of the closed vessel to hold the compression mechanism within the closed vessel.

15 Claims, 4 Drawing Sheets

CLOSED COMPRESSOR HAVING A COMPRESSION MECHANISM HOLDER AND METHOD OF ASSEMBLING SAME

BACKGROUND OF THE INVENTION

1. Field of the Invention

The present invention relates generally to a closed compressor and, in particular but not exclusively, to a closed compressor for use in, for example, an automobile air conditioner. The present invention also relates to a method of assembling such compressor.

2. Description of the Related Art

Conventionally, open compressors are generally used for air conditioners in engine-driven automobiles, while closed compressors (motor-driven compressors) that are employed in household air conditioners are generally used for air conditioners in electric cars.

FIG. 6 depicts a horizontal scroll compressor for use in a conventional household air conditioner. The compressor shown therein includes a compression mechanism 4 and a motor drive section 6 for driving the compression mechanism 4, both of which are contained in a closed vessel 2. The compression mechanism 4 includes a stationary scroll 4*a* fixedly mounted in the closed vessel 2, and an orbiting scroll 4*b* held in engagement with the stationary scroll 4*a* to undergo an orbiting motion relative thereto. The motor drive section 6 includes a stator 6*a* fixedly mounted in the closed vessel 2, and a rotor 6*b* for orbiting the orbiting scroll 4*b* relative to the stationary scroll 4*a*.

The orbiting scroll 4*b* has a shaft 4*c* integrally formed therewith so as to extend rearwardly therefrom. The shaft 4*c* is loosely inserted into an eccentric bearing 10 mounted on one end of a crankshaft 8, on an intermediate portion of which the rotor 6*b* is securely mounted. The one end of the crankshaft 8 is rotatably supported by a main bearing 12, which is held by a bearing support 14. The other end of the crankshaft 8 is similarly rotatably supported by an auxiliary bearing 18, which is held by a bearing support 16. Both the bearing Supports 14 and 16 are fixedly mounted in the closed vessel 2.

In assembling the scroll compressor of the above-described construction, the stationary scroll 4*a* is first held in engagement with the orbiting scroll 4*b* so as to allow the orbiting motion of the orbiting scroll 4*b* relative to the stationary scroll 4*a*. The stationary scroll 4*a* is then fixed on the bearing support 14 by means of a plurality of bolts, thus constituting the compression mechanism 4. Furthermore, the rotor 6*b* is shrink-fitted to the crankshaft 8, while a generally cylindrical shell 2*a* of the closed vessel 2 is shrink-fitted to the stator 6*a*.

Thereafter, the bearing support 16 on which the auxiliary bearing 18 is held is welded to the generally cylindrical shell 2*a*, and the crankshaft 8 to which the rotor 6*b* has been shrink-fitted is inserted into the stator 6*a* so that the compression mechanism 4 may be placed at a predetermined position in the proximity of an open end of the generally cylindrical shell 2*a*. The bearing support 14 is then welded to the generally cylindrical shell 2*a* through a plurality of openings (not shown) formed in the generally cylindrical shell 2*a*. Finally, a pair of side shells 2*b*, 2*c* are welded to the generally cylindrical shell 2*a*, thereby completing the assembling work.

In the case of the scroll compressor assembled in the above-described manner, the stationary scroll 4*a* constituting the compression mechanism 4 and the bearing support 14 are both made of iron-based material and, hence, they have a great influence on the weight of the compressor. However, the weight requirement (weight-saving) on the compressors for household air conditioner is not so strong as that on the compressors for automobiles.

Recently, there is an increasing demand for environmental protection or energy saving, and automobiles of lighter weight are also demanded. Particularly, as far as electric cars are concerned, the lighter weight is one of the most important problems, because the electric cars are inferior in driving force to gasoline-driven cars.

In view of the need for lighter weight, it is conceivable that the component parts of the compression mechanism be changed from iron-based material to aluminum or aluminum-based material. In that case, however, if conventional gas welding is employed to fix the compression mechanism to the generally cylindrical shell, there arises a problem in that the aluminum-based material is fused and, hence, joining is not possible.

SUMMARY OF THE INVENTION

The present invention has been developed to overcome the above-described disadvantages.

It is accordingly an objective of the present invention to provide a closed compressor having a reduced weight wherein any optional material can be used for component parts of a compression mechanism.

Another objective of the present invention is to provide the closed compressor of the above-described type which can be assembled with ease and in which the predetermined dimensional accuracy before assemblage can be maintained even after assemblage.

A further objective of the present invention is to provide a method of assembling such closed compressor.

In accomplishing the above and other objectives, the closed compressor according to the present invention includes a closed vessel, a compression mechanism contained in the closed vessel, a motor drive section for driving the compression mechanism, and a compression mechanism holder secured to the closed vessel for holding the compression mechanism within the closed vessel.

This construction makes it possible to use any optional material for component parts of the compression mechanism to reduce the weight of the compressor. Furthermore, unlike the conventional compressors, it is not necessary to weld a portion of the compression mechanism to the closed vessel. Accordingly, no thermal stains are created in the compression mechanism and, hence, the predetermined dimensional accuracy before assemblage can be maintained even after assemblage.

The compression mechanism is fastened to the compression mechanism holder by threading each of a plurality of first bolts into a nut secured to the compression mechanism holder or an internally threaded projection formed with the compression mechanism holder.

With this simple construction, the compression mechanism can be readily securely mounted on the closed vessel.

The compression mechanism holder has a plurality of bolt holes defined therein. Each bolt hole has a diameter greater than the width across the corners of the heads of a plurality of second bolts for use in assembling the compression mechanism so that the heads of the second bolts may be loosely inserted into the bolt holes, respectively.

By so doing, when the compression mechanism is fastened to the compression mechanism holder, the heads of the second bolts do not interfere with the compression mechanism holder, thus facilitating assemblage.

Advantageously, the compression mechanism is made of aluminum or aluminum-based material to considerably reduce the weight of the compressor.

The method of assembling a closed compressor according to the present invention includes the steps of: engaging a stationary scroll with an orbiting scroll so as to allow an orbiting motion of the orbiting scroll relative to the stationary scroll; fastening the stationary scroll to a bearing support by means of a plurality of first bolts, thus constituting the compression mechanism; fastening a compression mechanism holder made of a steel plate to the closed vessel; and fastening the compression mechanism to the compression mechanism holder by means of a plurality of second bolts.

This method makes it possible to use any optional material for component parts of the compression mechanism to reduce the weight of the compressor. Also, because it is not necessary to weld a portion of the compression mechanism to the closed vessel, no thermal stains are created in the compression mechanism and, hence, the predetermined dimensional accuracy before assemblage can be maintained even after assemblage.

The method according to the present invention includes the steps of shrink-fitting a rotor of the motor drive section to a crankshaft; shrink-fitting the closed vessel to a stator of the motor drive section; and inserting the crankshaft together with the rotor into the stator through a center opening formed in the compression mechanism holder. By so doing, the compressor can be readily assembled.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

This application is based on application No. 11-15618 filed Jan. 25, 1999 in Japan, the content of which is incorporated hereinto by reference.

Figure 1:
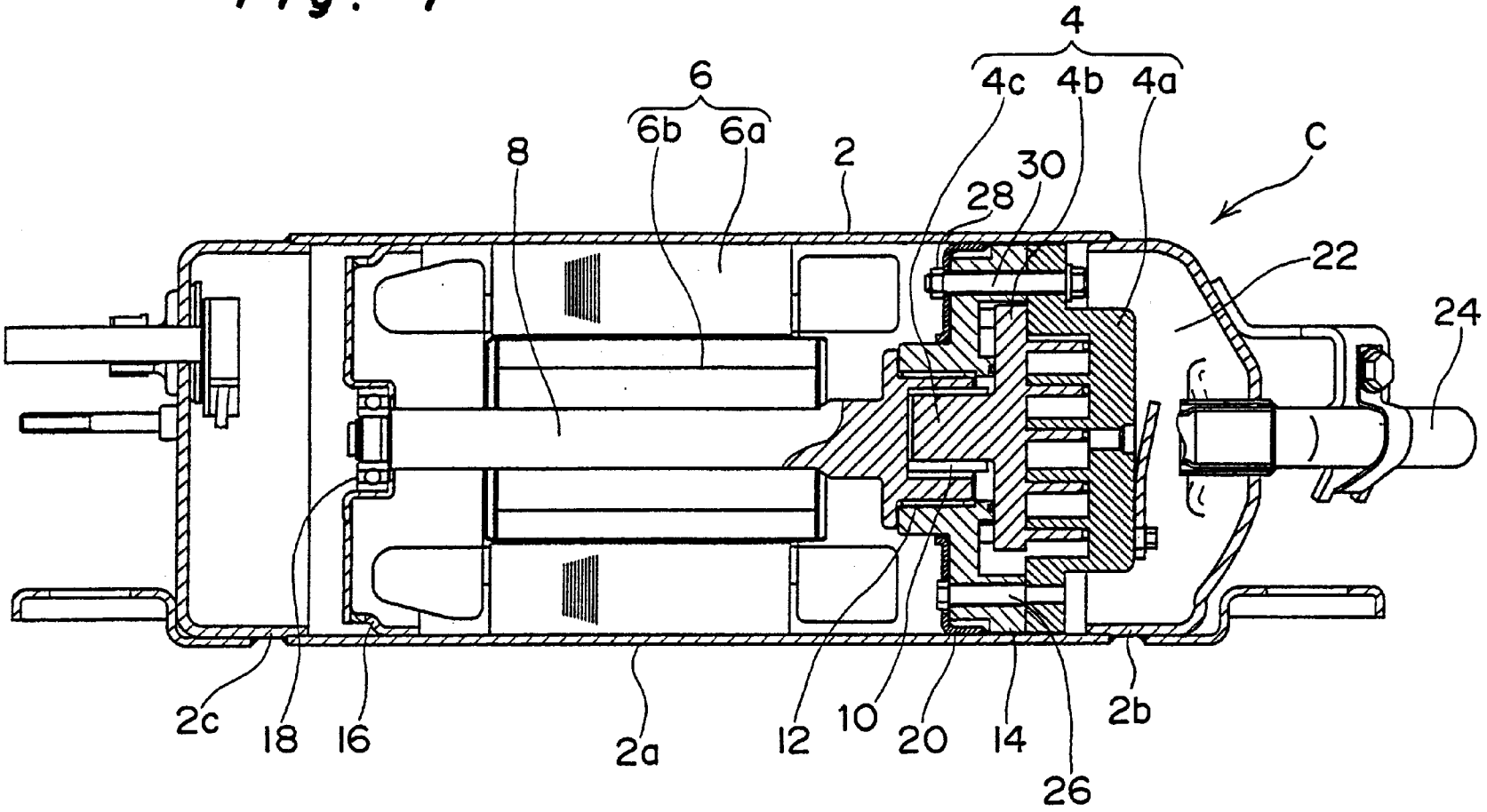
FIG. 1 is a vertical sectional view of a closed compressor according to the present invention.

Referring now to the drawings, there is shown in FIG. 1 a horizontal scroll compressor C embodying the present invention. The compressor C includes a compression mechanism 4 and a motor drive section 6 for driving the compression mechanism 4, both of which are contained in a closed vessel 2. The compression mechanism 4 includes a stationary scroll 4*a* fixedly mounted in the closed vessel 2, and an orbiting scroll 4*b* held in engagement with the stationary scroll 4*a* to undergo an orbiting motion relative thereto. The motor drive section 6 includes a stator 6*a* fixedly mounted in the closed vessel 2, and a rotor 6*b* for orbiting the orbiting scroll 4*b* relative to the stationary scroll 4*a*.

The orbiting scroll 4*b* has a shaft 4*c* integrally formed therewith so as to extend rearwardly therefrom. The shaft 4*c* is loosely inserted into an eccentric bearing 10 mounted on one end of a crankshaft 8, on an intermediate portion of which the rotor 6*b* is securely mounted. The one end of the crankshaft 8 is rotatably supported by a main bearing 12, which is held by a bearing support 14. The bearing support 14 is in turn held by a compression mechanism holder 20 welded to the inner surface of the closed vessel 2. The other end of the crankshaft 8 is rotatably supported by an auxiliary bearing 18, which is held by a bearing support 16 fixedly mounted in the closed vessel 2.

In the above-described construction, upon receipt of a driving force of the crankshaft 8 that rotates together with the rotor 6*b* of the motor drive section 6, the orbiting scroll 4*b* undergoes an orbiting motion relative to the stationary scroll 4*a* to compress a suction gas. The compressed high-pressure gas is introduced into a discharge chamber 22 and then discharged outside the closed vessel 2 through a discharge pipe 24.

In assembling the scroll compressor C of the above-described construction, the stationary scroll 4*a* is first held in engagement with the orbiting scroll 4*b* so as to allow the orbiting motion of the orbiting scroll 4*b* relative to the stationary scroll 4*a*. The stationary scroll 4*a* is then fixed on the bearing support 14 by means of a plurality of (for example, six) bolts 26, thus constituting the compression mechanism 4. Furthermore, the rotor 6*b* is shrink-fitted to the crankshaft 8, while a generally cylindrical shell 2*a* of the closed vessel 2 is shrink-fitted to the stator 6*a*.

Thereafter, the bearing support 16 on which the auxiliary bearing 18 is held is welded to the generally cylindrical shell 2*a*, and the compression mechanism holder 20 is welded to the generally cylindrical shell 2*a*.

Figure 2:
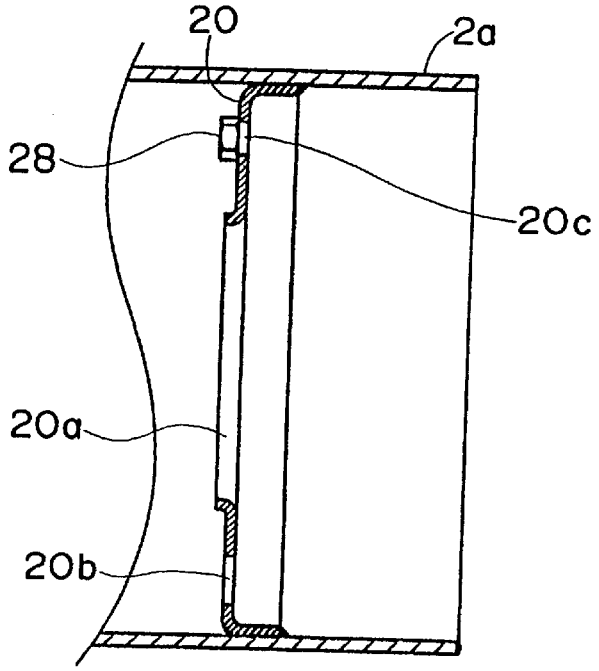
FIG. 2 is a vertical sectional view of a compression mechanism holder mounted in the closed compressor of FIG. 1.
Figure 3:
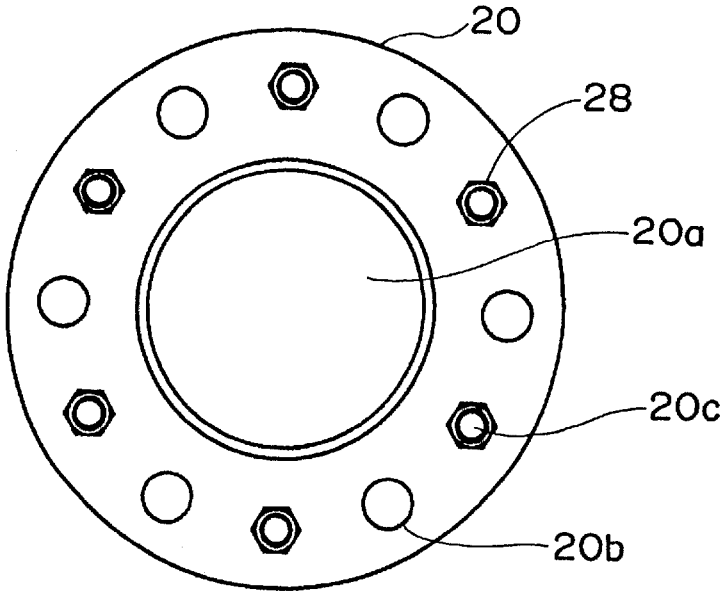
FIG. 3 is a top plan view of the compression mechanism holder of FIG. 2.

As shown in FIGS. 2 and 3, the compression mechanism holder 20 is a member that is formed of a steel plate and has been configured into a predetermined shape. The compression mechanism holder 20 has a center opening 20*a* defined therein and having a diameter greater than the external diameter of the rotor 6*b*, and also has a plurality (first group) of large-diameter bolt holes 20*b* and a plurality (second group) of small-diameter bolt holes 20*c*. The large-diameter bolt holes 20*b* and the small-diameter bolt holes 20*c* are alternately formed at regular intervals around the center opening 20*a*. A plurality of nuts 28 are secured to the rear surface of the compression mechanism holder 20 at locations around the small-diameter bolt holes 20*c* by projection welding.

The diameter of each of the first group of large-diameter bolt holes 20*b* is greater than the width across the corners of each of a first group of bolts 26 that fasten the stationary scroll 4*a* and the bearing support 14 together.

The crankshaft 8 to which the rotor 6*b* has been shrink-fitted is inserted into the stator 6*a* through the center hole 20*a* of the compression mechanism holder 20 so that the compression mechanism 4 may be placed at a predetermined position in the proximity of an open end of the generally cylindrical shell 2*a*. At this moment, each of the first group of bolts 26 are aligned with a respective one of the first group of large-diameter bolt holes 20*b* of the compression mechanism holder 20, and the heads of the former are loosely inserted into the latter. The compression mechanism 4 is then fastened to the compression mechanism holder 20 by threading a plurality (second group) of bolts 30 into the nuts 28 welded to the compression mechanism holder 20.

Finally, a pair of side shells 2*b*, 2*c* are welded to the generally cylindrical shell 2*a*, thereby completing the assembling work.

In the scroll compressor C assembled in the above-described manner, because the compression mechanism 4 is secured to and held by the generally cylindrical shell 2*a* via the compression mechanism holder 20, it is not necessary to directly join the component parts of the compression mechanism 4 to the generally cylindrical shell 2*a*. Accordingly, any optional material can be used for the component parts of the compression mechanism 4.

For this reason, the stationary scroll 4*a*, the orbiting scroll 4*b*, and the bearing support 14 that are assembled together by the first group of bolts 26 can be all made of aluminum or aluminum-based material and, hence, the weight of the compression mechanism 4 having a great influence on the weight of the compressor can be considerably reduced. Because the compression mechanism 4 employing aluminum-based material has superior vibration damping characteristics, a reduction in noise is expected.

Figure 4:
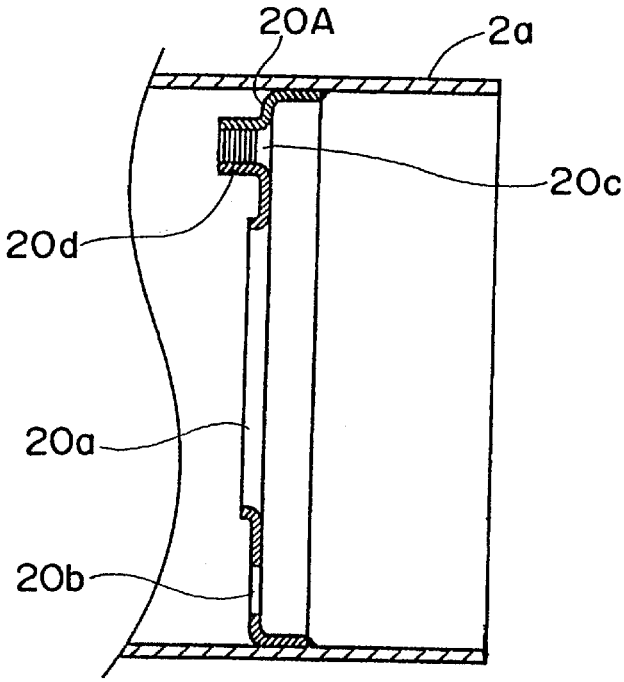
FIG. 4 is a view similar to FIG. 2, but depicting a modification thereof.
Figure 5:
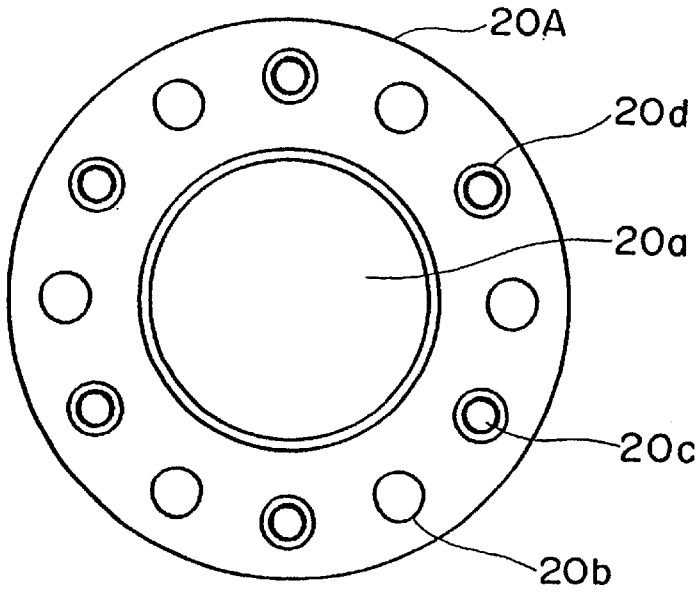
FIG. 5 is a top plan view of the compression mechanism holder of FIG. 4.
Figure 6:
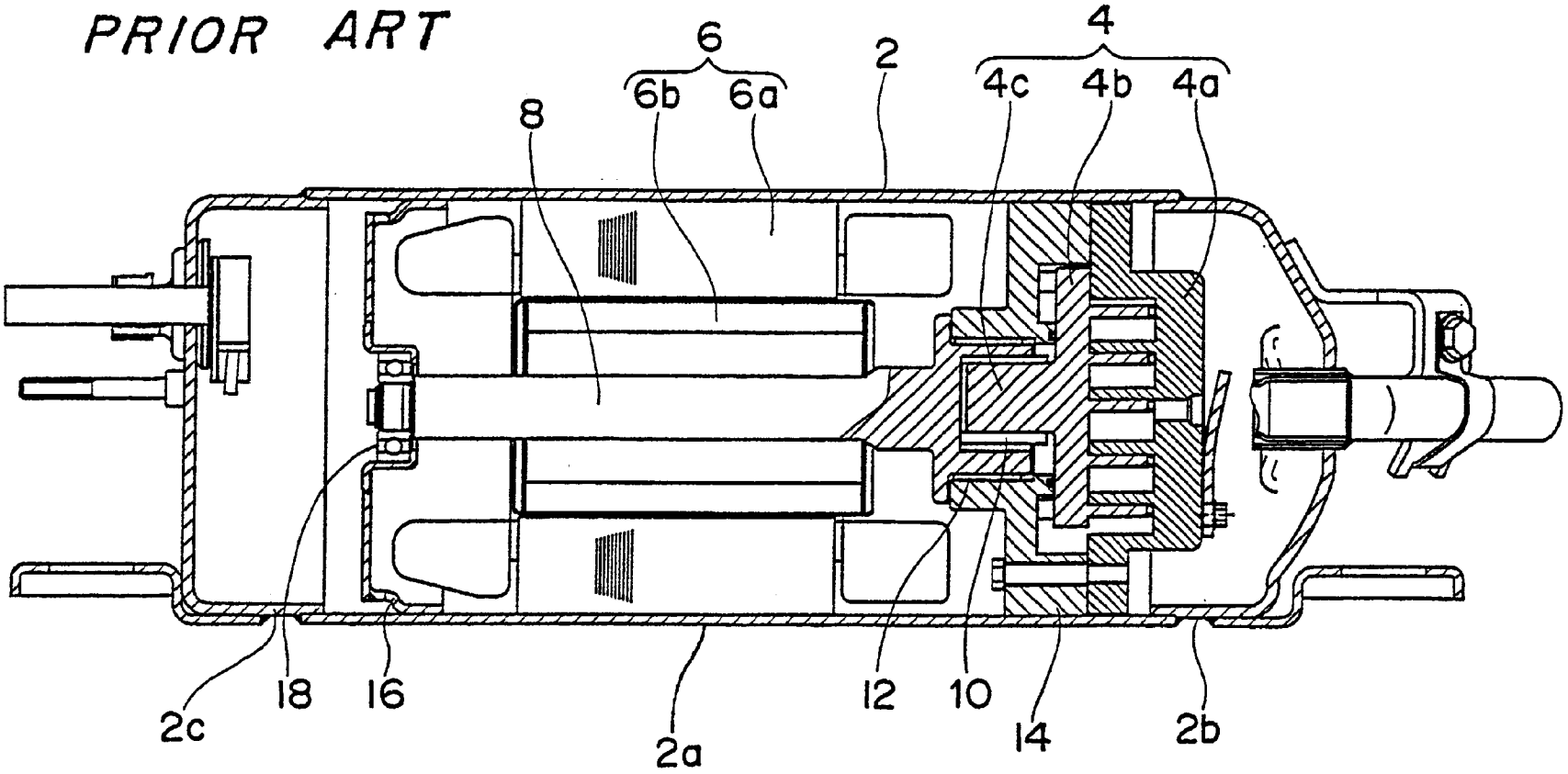
Fig. 6 PRIOR ART
FIG. 6 is a vertical sectional view of a conventional closed compressor .

FIGS. 4 and 5 depict a modification 20A of the compression mechanism holder 20 referred to above.

Although the compression mechanism holder 20 shown in FIGS. 2 and 3 employs the nuts 28, the compression mechanism holder 20A shown in FIGS. 4 and 5 employs a plurality of rearwardly protruding and internally threaded cylindrical portions 20*d* integrally formed therewith at locations corresponding to the nuts 28.

Where the above-described compression mechanism holder 20A is used, the bolts 30 for fastening the compression mechanism 4 to the compression mechanism holder 20A are threaded into the internally threaded cylindrical portions 20*d*. Because the method of assembling other component parts of the compressor is the same as in the case where the compression mechanism holder 20 is used, explanation thereof is omitted.

It is to be noted that although the weight of the whole compressor can be reduced by using aluminum or aluminum-based material for the component parts of the compression mechanism 4, it is also possible to use such material for only the orbiting scroll 4*b* and iron-based material for the stationary scroll 4*a* and the bearing support 14, as in the conventional compression mechanism. In this case, the light weight of the compressor cannot be attained. However, because it is not necessary to weld a portion of the compression mechanism 4 to the generally cylindrical shell 2*a*, no thermal stains are created in the compression mechanism 4, making it possible to maintain, even after assemblage, the predetermined dimensional accuracy before assemblage.

It is also to be noted that although in the above-described embodiments discussion has been made by taking the case of a horizontal scroll compressor, the present invention is also applicable to vertical scroll compressors and, also, to rotary compressors in which the compression mechanism is made up of a piston, a cylinder and the like.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A closed compressor comprising:

a closed vessel;

a compression mechanism contained in said closed vessel, said compression mechanism including a stationary scroll and a bearing support fixed to said stationary scroll by a first group of bolts;

a motor drive section for driving said compression mechanism; and a compression mechanism holder secured to said closed vessel and fixed to said bearing support of said compression mechanism so as to hold said compression mechanism within said closed vessel, said compression mechanism holder having a first group of bolt holes and a second group of bolt holes, each of said first group of bolts including a bolt head having a width smaller than a diameter of each of said first group of bolt holes, said bearing support being arranged between said compression mechanism holder and said stationary scroll and each of said first group of bolts being inserted into a respective one of said first group of bolt holes such that said bolt head of each of said first group of bolts is arranged within said respective one of said first group of bolt holes so as to fix said bearing support to said stationary scroll, and each of a second group of bolts being inserted into a respective one of said second group of bolt holes so as to connect said compression mechanism holder to said stationary scroll with said bearing support arranged therebetween.

2. The closed compressor of claim 1, further comprising a plurality of nuts secured to said compression mechanism holder at said second group of bolt holes such that each of said nuts is concentric with a respective one of said second group of bolt holes, each of said second group of bolts being threaded into a respective one of said nuts.

3. The closed compressor of claim 2, wherein said compression mechanism is formed of an aluminum-based material.

4. The closed compressor of claim 1, wherein each of said second group of bolt holes includes an internally threaded projection, each of said second group of bolts being threaded into a respective one of said projections.

5. The closed compressor of claim 4, wherein said compression mechanism is formed of an aluminum-based material.

6. The closed compressor of claim 1, wherein said compression mechanism is formed of an aluminum-based material.

7. The closed compressor of claim 1, wherein said compression mechanism holder has a center opening, said first group of bolt holes and said second group of bolt holes being alternately arranged around said center opening.

8. The closed compressor of claim 1, wherein said compression mechanism holder is welded to an inner surface of said closed vessel.

9. The closed compressor of claim 1, wherein said compression mechanism further includes an orbiting scroll and a bearing, said orbiting scroll engaging said stationary scroll and being supported by said bearing, said bearing being connected to said bearing support.

10. A method of assembling a closed compressor, comprising:

engaging a stationary scroll and an orbiting scroll so as to allow the orbiting scroll to move in an orbiting manner relative to the stationary scroll;

fastening a bearing support to the stationary scroll using a first group of bolts so as to form a compression mechanism;

securing a compression mechanism holder formed of steel plate to a closed vessel so that the compression mechanism is located against the bearing support of the compression mechanism whereby the bearing support is located between the compression mechanism holder and the stationary scroll, the compression mechanism holder having a first group of bolt holes and a second group of bolt holes, each of the first group of bolts including a bolt head having a width smaller than a diameter of each of the first group of bolt holes such that the bolt head of each of the first group of bolts is arranged within a respective one of the first group of bolt holes;

fastening the compression mechanism holder to the compression mechanism by inserting a second group of bolts into the second group of bolt holes.

11. The method of claim 10, further comprising:

shrink-fitting a rotor of a motor drive section to crankshaft;

shrink-fitting the closed vessel to a stator of the motor drive section; and inserting the crankshaft and the rotor into the stator through a center opening in the compression mechanism holder.

12. The method of claim 10, further comprising:

securing a nut to the compression mechanism holder at each of the second group of bolt holes such that each nut is concentric with a respective one of the second group of bolt holes; and threading each of the second group of bolts into a respective one of the nuts.

13. The method of claim 10, further comprising threading each of the second group of bolts into an internally threaded projection formed at each of the second group of bolt holes.

14. The method of claim 10, further comprising alternately arranging the first group of bolt holes and the second group of bolt holes around a center opening in the compression mechanism holder.

15. The method of claim 10, wherein said securing of the compression mechanism holder to the closed vessel comprises welding the compression mechanism holder to an inner surface of the closed vessel.

* * * * *